US008695144B2

(12) United States Patent
Jang et al.

(10) Patent No.: US 8,695,144 B2
(45) Date of Patent: Apr. 15, 2014

(54) AUTONOMOUS CLEANING MACHINE

(71) Applicant: Samsung Electronics Co., Ltd., Suwon-si (KR)

(72) Inventors: Hwi Chan Jang, Suwon-si (KR); Dong Won Kim, Hwaseong-si (KR); Woo Ram Chung, Seoul (KR); Jae Man Joo, Suwon-si (KR); Jun Pyo Hong, Suwon-si (KR); Jae Young Jung, Suwon-si (KR); Kyung Hwan Yoo, Incheon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/869,220

(22) Filed: Apr. 24, 2013

(65) Prior Publication Data

US 2013/0232703 A1 Sep. 12, 2013

Related U.S. Application Data

(63) Continuation of application No. 12/662,854, filed on May 6, 2010, now Pat. No. 8,443,477.

(30) Foreign Application Priority Data

May 15, 2009 (KR) ..... 10-2009-0042785
Dec. 8, 2009 (KR) ..... 10-2009-0120918

(51) Int. Cl.
*A47L 11/28* (2006.01)

(52) U.S. Cl.
USPC ..... 15/41.1; 15/44; 15/52.1; 15/43; 15/98

(58) Field of Classification Search
USPC ..... 15/41.1, 44, 43, 4, 52.1, 98, 50.3
See application file for complete search history.

(56) References Cited

U.S. PATENT DOCUMENTS

| | | | |
|---|---|---|---|
| 4,823,422 | A | 4/1989 | Yoshimura et al. |
| 6,845,538 | B2 | 1/2005 | Nakamura |
| 2004/0049877 | A1 | 3/2004 | Jones et al. |

FOREIGN PATENT DOCUMENTS

| | | |
|---|---|---|
| DE | 102007036227 | 2/2009 |
| JP | 6-86743 | 3/1994 |
| JP | 2008-382 | 1/2008 |
| KR | 10-2008-0102645 | 11/2008 |
| WO | 2006/068403 | 6/2006 |

OTHER PUBLICATIONS

Office Action mailed Sep. 10, 2012 in U.S. Appl. No. 12/662,854.
Applicant-Initiated Interview Summary mailed Jan. 10, 2013 in U.S. Appl. No. 12/662,854.
Notice of Allowance mailed Jan. 24, 2013 in U.S. Appl. No. 12/662,854.
U.S. Appl. No. 12/662,854, filed May 6, 2010, Jang et al., Samsung Electronics Co., Ltd.
Extended European Search Report dated Aug. 1, 2013 in European Patent Application No. 10161936.9.

*Primary Examiner* — Shay Karls
(74) *Attorney, Agent, or Firm* — Staas & Halsey LLP

(57) ABSTRACT

Disclosed herein is an autonomous cleaning machine with a brush cleaning unit to clean a brush unit. The autonomous cleaning machine includes a main body, the brush unit rotatably provided on the main body, first brush cleaning members contacting the brush unit to move foreign substances wound on the brush unit in a lengthwise direction of the brush unit, and second brush cleaning members contacting the brush unit to remove the foreign substances wound on the brush unit from the brush unit.

9 Claims, 16 Drawing Sheets

AUTONOMOUS CLEANING MACHINE

CROSS-REFERENCE TO RELATED APPLICATIONS

This application is a continuation of U.S. patent application Ser. No. 12/662,854 filed May 6, 2010. This application claims the priority benefit of U.S. patent application Ser. No. 12/662,854 filed May 6, 2010, the disclosure of which is incorporated herein by reference. This application claims the benefit of Korean Patent Application Nos. 10-2009-0042785, filed on May 15, 2009, and 10-2009-0120918, filed on Dec. 8, 2009, in the Korean Intellectual Property Office, the disclosures of which are incorporated herein by reference.

BACKGROUND

1. Field

Embodiments relate to an autonomous cleaning machine having a cleaning device.

2. Description of the Related Art

In general, an autonomous cleaning machine is an apparatus which removes dust from the floor while traveling in a region to be cleaned without user manipulation. The autonomous cleaning machine controls a driving device to completely clean the region to be cleaned, and controls a cleaning device to effectively remove dust.

The autonomous cleaning machine may not be continuously managed by a user, and thus may assure cleaning performance by itself. For example, the autonomous cleaning machine uniformly maintains the cleaning performance thereof through feedback of an electrical signal by the driving device and the cleaning device. Otherwise, the autonomous cleaning machine may uniformly maintain the cleaning performance thereof by a different mechanical configuration.

SUMMARY

Therefore, it is one aspect to provide an autonomous cleaning machine in which a structure of a cleaning mechanism is improved so as to uniformly maintain cleaning performance thereof.

Additional aspects will be set forth in part in the description which follows and, in part, will be apparent from the description, or may be learned by practice of the invention.

The foregoing and/or other aspects are achieved by providing an autonomous cleaning machine to clean a floor including a main body, a brush unit rotatably provided on the main body, a plurality of first brush cleaning members contacting the brush unit to move foreign substances wound on the brush unit in a lengthwise direction of the brush unit, and a plurality of second brush cleaning members contacting the brush unit to remove the foreign substances wound on the brush unit from the brush unit.

The first brush cleaning members may be arranged bilaterally symmetrically so as to move the foreign substances to a central portion of the brush unit.

The brush unit may include brushes contacting the floor, and the first brush cleaning members may be installed such that each of the first brush cleaning members is respectively inclined in a designated direction based on a rotating direction of the brush unit so as to apply pressure to the brushes to elastically deform the brushes in the designated direction.

Among the first brush cleaning members, the first brush cleaning members provided at the left side may be inclined to the right based on the rotating direction of the brush unit, and the first brush cleaning members provided at the right side may be inclined to the left based on the rotating direction of the brush unit.

The second brush cleaning members may be arranged in the lengthwise direction of the brush unit.

The second brush cleaning members may be arranged at the central portion of the brush unit.

Each of the second brush cleaning members may include a pick-up and guide part to pick up the foreign substances wound on the brush unit and to move the foreign substances to the outside of the brush unit along a rotating radius of the brush unit.

The pick-up and guide part may be arranged in the vertical direction.

The pick-up and guide part may be located at a height lower than a top dead center of the rotating radius of the brush unit.

The autonomous cleaning machine may further include a dust collection assembly provided on the main body, and the pick-up and guide part may guide the foreign substances to the dust collection assembly.

The pick-up and guide part may include a sharpened part which is interfered with by the brush unit.

The foregoing and/or other aspects are achieved by providing an autonomous cleaning machine including a main body, a brush unit rotatably provided on the main body, and a brush cleaning unit provided on the main body and contacting the brush unit, wherein the brush cleaning unit collects foreign substances wound on the brush unit at one portion of the brush unit, and then removes the foreign substances from the brush unit.

The brush cleaning unit may include first brush cleaning members to collect the foreign substances at a central portion of the brush unit, and second brush cleaning members to remove the foreign substances from the brush unit.

The first brush cleaning members may be installed such that each of the first brush cleaning members is respectively inclined in a designated direction based on a rotating direction of the brush unit, and the first brush cleaning members may be arranged bilaterally symmetrically.

The second brush cleaning members may be arranged vertically, and be located at a height lower than a top dead center of a rotating radius of the brush unit.

The foregoing and/or other aspects are achieved by providing an autonomous cleaning machine including a main body, a brush unit rotatably provided on the main body, and a brush cleaning unit provided on the main body and contacting the brush unit, wherein the brush cleaning unit prevents foreign substances wound on the brush unit from being removed from the brush unit to the outside of the brush unit in a direction of a rotary axis of the brush unit, and allows the foreign substances to be removed from the brush unit to an outside of the brush unit in a direction of a rotating radius of the brush unit.

The autonomous cleaning machine may further include at least one third brush cleaning member arranged adjacent to connection portions between the main body and the brush unit to move the foreign substances wound on the brush unit to other portions except for the connection portions between the main body and the brush unit.

The at least one third brush cleaning member may move the foreign substances wound on the brush unit to a central region of the brush unit, and the first brush cleaning members may move the foreign substances, moved to the central region of the brush unit by the at least one third brush cleaning member, to the center of the brush unit in the lengthwise direction of the brush unit.

In accordance with yet another aspect, an autonomous cleaning machine includes a main body, a brush unit rotatably provided on the main body, a plurality of connection portions, and a brush cleaning unit to clean the brush unit, wherein the brush cleaning unit is arranged adjacent to ones of the connection portions between the main body and the brush unit to move foreign substances wound on the brush unit to portions of the brush unit other than the connection portions between the main body and the brush unit.

The brush cleaning unit may move the foreign substances wound on the brush unit to a central region of the brush unit.

The brush cleaning unit may include at least one third brush cleaning member protruded from the outside of the brush unit to the inside of the brush unit in the lengthwise direction of the brush unit.

The brush unit may include brushes made of an elastic material, and the at least one third brush cleaning member may include an inclined part inclined at a designated angle to elastically deform the brushes toward the center of the brush unit.

The at least one third brush cleaning member may be located adjacent to each of both ends of the brush unit.

The main body may include a drum case in which the brush unit is mounted, and a brush cover attached to and detached from the drum case, and the at least one third brush cleaning member may be installed on the brush cover.

The drum case may include at least one connection groove into which the brush unit is inserted, the brush unit may include at least one connection protrusion attached to and detached from the at least one connection groove, and the at least one third brush cleaning member may be arranged adjacent to a connection portion between the at least one connection groove and the at least one connection protrusion.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
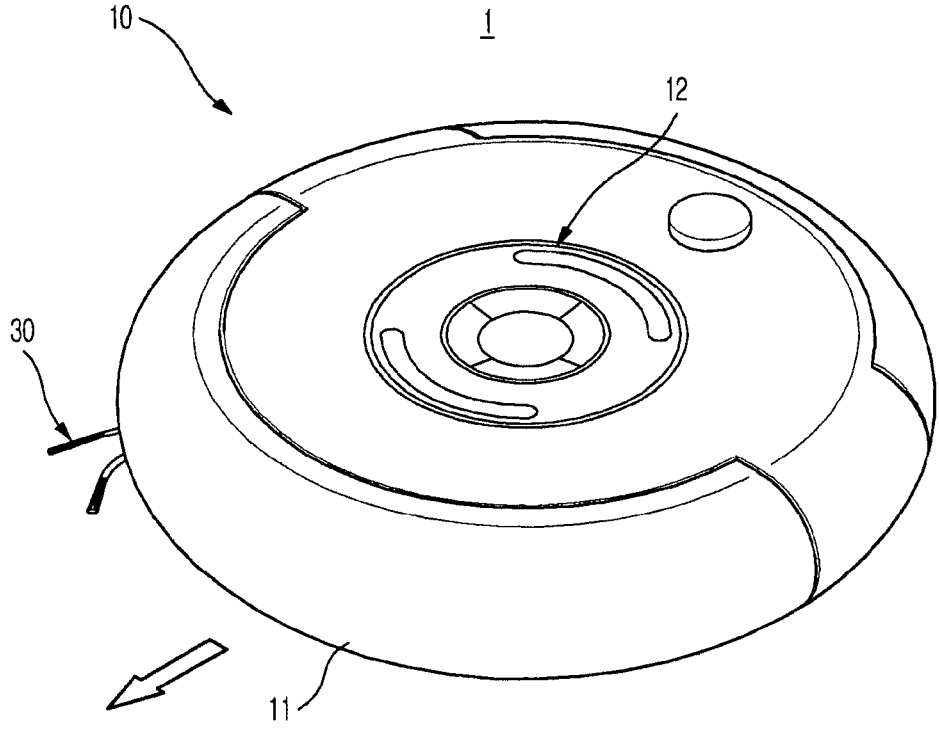
FIG. 1 is a top perspective view of an autonomous cleaning machine in accordance with one embodiment.

Reference will now be made in detail to the embodiments, examples of which are illustrated in the accompanying drawings, wherein like reference numerals refer to like elements throughout.

Figure 2:
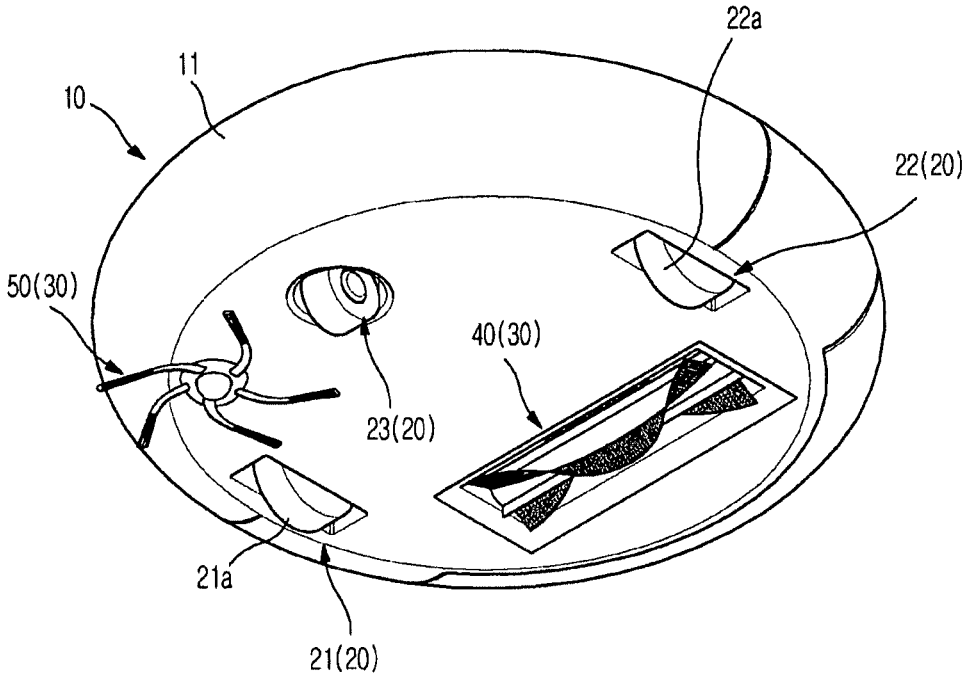
FIG. 2 is a bottom perspective view of the autonomous cleaning machine in accordance with the embodiment.
Figure 3:
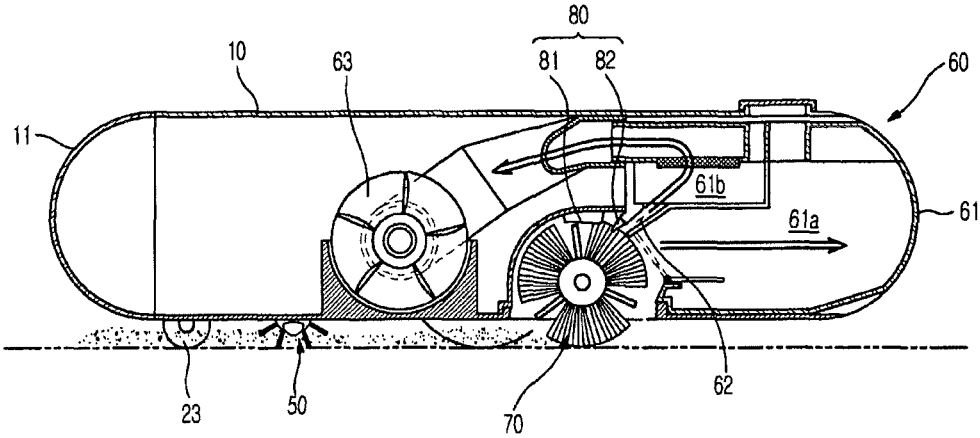
FIG. 3 is a longitudinal-sectional view of the autonomous cleaning machine in accordance with the embodiment.

FIG. 1 is a top perspective view of an autonomous cleaning machine in accordance with one embodiment, FIG. 2 is a bottom perspective view of the autonomous cleaning machine in accordance with the embodiment, and FIG. 3 is a longitudinal-sectional view of the autonomous cleaning machine in accordance with the embodiment.

As shown in FIGS. 1 to 3, an autonomous cleaning machine 1 in accordance with one embodiment includes a main body 10, a driving device 20, a cleaning device 30, and a controller (not shown). The driving device 20 may include a driving mechanism mounted on the main body 10 to adjust the autonomous cleaning machine 1. The cleaning device 30 may include a cleaning mechanism mounted on the main body 10 to clean the floor under the autonomous cleaning machine 1 as well as regions around the autonomous cleaning machine 1. The controller supplies a command to components of the autonomous cleaning machine 1 based on a sensor or a signal, such as a sequence, thereby allowing the autonomous cleaning machine 1 to autonomously clean the floor.

Various components of the autonomous cleaning machine 1 may be installed on the main body 10. The driving device 20 and the cleaning device 30 may be installed on the main body 10, and a contact sensor and a proximity sensor to sense obstacles may be further installed on the main body 10. In one example of the contact sensor, a bumper 11 installed on the front portion of the main body 10 may be used to sense an obstacle, such as a wall, and in one example of the proximity sensor, an infrared sensor (or an ultrasonic sensor) installed on the bottom of the main body 10 may be used to sense an obstacle, such as a stairway. Further, a display device 12 may be installed on the main body 10. The display device 12 informs a user of a state of the autonomous cleaning machine 1 or information regarding operation of the autonomous cleaning machine 1.

The driving device 20 includes a left driving wheel assembly 21, a right driving wheel assembly 22, and a caster wheel assembly 23. The left and right driving wheel assemblies 21 and 22 and the caster wheel assembly 23 are connected to the main body 10, and thus allow the autonomous cleaning machine 1 to travel while supporting the autonomous cleaning machine 1. The controller supplies a command to the driving device 20 to drive left and right wheels 21*a* and 22*a* forward and backward, thereby being capable of changing a traveling direction of the autonomous cleaning machine 1. For example, the controller may drive the left and right wheels 21*a* and 22*a* in the same direction so as to cause the autonomous cleaning machine 1 to move forward or backward. Further, the controller may drive the left and right wheels 21*a* and 22*a* in different directions so as to cause the autonomous cleaning machine 1 to be rotated left or right based on the traveling direction thereof, or to be gyrated.

The cleaning device 30 includes a main cleaning assembly 40 and an edge cleaning assembly 50. The main cleaning assembly 40 is installed on the bottom of the main body 10 so as to clean the floor on which the autonomous cleaning machine 1 is located, and the edge cleaning assembly 50 is installed at one side of the main body so as to clean regions around the autonomous cleaning machine 1. Particularly, the edge cleaning assembly 50 moves dust or residue located in the regions around the autonomous cleaning machine 1 into a traveling path of the autonomous cleaning machine 1, and then the main cleaning assembly 40 removes the dust or residues on the traveling path while moving the autonomous cleaning machine 1 along the traveling path.

The main cleaning assembly 40 includes a brush unit 70 and a brush cleaning unit 80. The brush unit 70 sweeps dust or residues stacked on the floor under the autonomous cleaning machine 1 into a dust container 61 of a dust collection assembly 60. Further, the dust collection assembly 60 inhales dust or residue scattered by the brush unit 70 using vacuum suction force and then stores the inhaled dust or residue in the dust container 61. If foreign substances, such as strings, threads, hairs, or fur, are wound on the brush unit 70 and thus the brush unit 70 malfunctions, overcurrent may flow in a brush motor 71 or a temperature of the brush motor 71 may increase. The controller performs feedback of an electrical signal based on sensor measurement so as to detect overcurrent or temperature increase, thereby allowing the autonomous cleaning machine 1 to uniformly maintain the cleaning performance thereof while removing obstacles. For example, if overcurrent is detected, the brush unit 70 is rotated in the reverse direction so as to, release foreign substances from the brush unit 70. The main cleaning assembly 40 includes a mechanical configuration, thereby allowing the brush unit 70 to uniformly maintain the performance thereof. That is, the main cleaning assembly 40 further includes the brush cleaning unit 80 to remove foreign substances wound on the brush unit 70.

Figure 4:
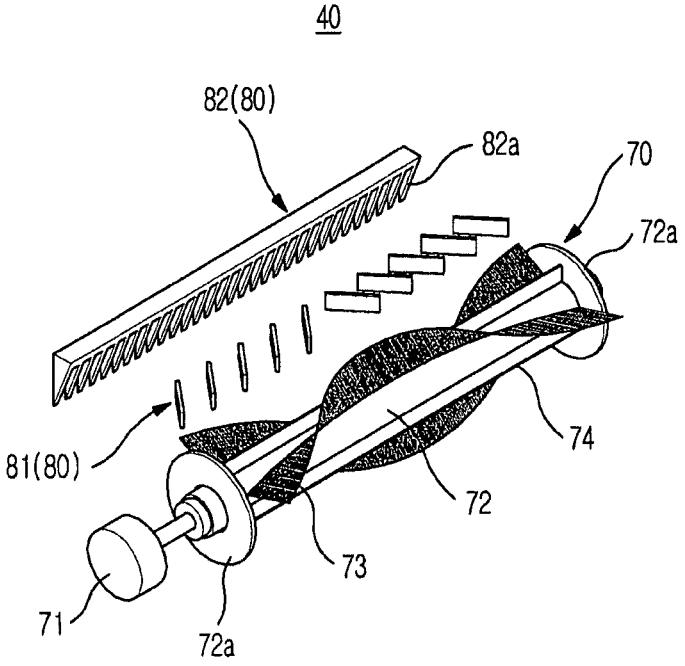
FIG. 4 is a perspective view illustrating a brush unit and a brush cleaning unit in accordance with the embodiment.

FIG. 4 is a perspective view illustrating the brush unit and the brush cleaning unit in accordance with the embodiment.

With reference to FIGS. 1 to 4, the brush unit 70 is robtatably connected to the main body 10. The brush unit 70 includes the motor 71, a roller 72, and brushes 73, The roller 72 is made of a rigid body, is rotatably connected to the main body 10, and is driven by the motor 71.

End caps 72*a* are installed at both ends of the roller 72, and thus prevent foreign substances from moving to the motor 71. The brushes 73 are made of an elastic material, and are implanted into the roller 72. While the autonomous cleaning machine 1 travels, the brushes 73 are driven together with the roller 72, and scatter dust or residue on the floor.

The brush unit 70 further includes flaps 74 made of an elastic material. The plural flaps 74 are installed in the lengthwise direction of the roller 72, and are separated from each other at designated intervals. The plural flaps 74 serve to increase a diameter of the brush unit 70, on which foreign substances, such as hairs, are wound, and to minimize frictional force between the brush unit 70 and the foreign substances. That is, the flaps 74 cause the foreign substances not to be wound directly on the roller 72 but to be wound on the flaps 74, and thus minimize frictional force with the foreign substances due to contact and reduce energy required to remove the foreign substances.

The brush cleaning unit 80 serves to remove foreign substances, such as hairs, wound on the brush unit 70. The brush cleaning unit 80 includes first brush cleaning members 81 and second brush cleaning members 82. The first brush cleaning members 81 move foreign substances to the central portion of the brush unit 70, and the second brush cleaning members 82 move the foreign substances to the outside of the brush unit 70.

Figure 5:
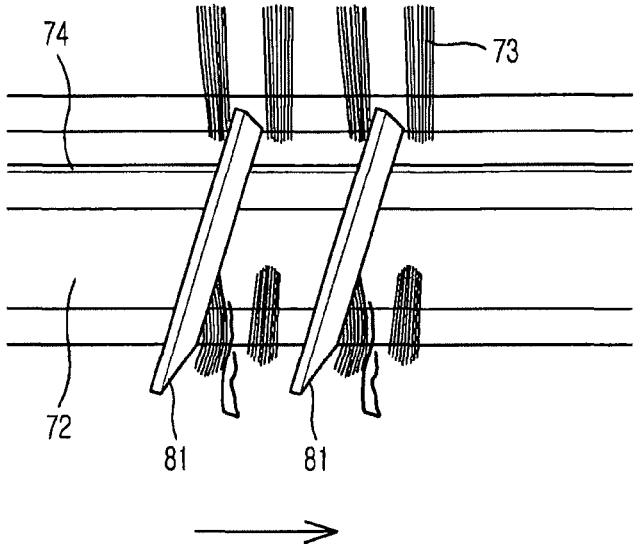
FIGS. 5 to 7 are views illustrating operation of first brush cleaning members in accordance with the embodiment.
Figure 6:
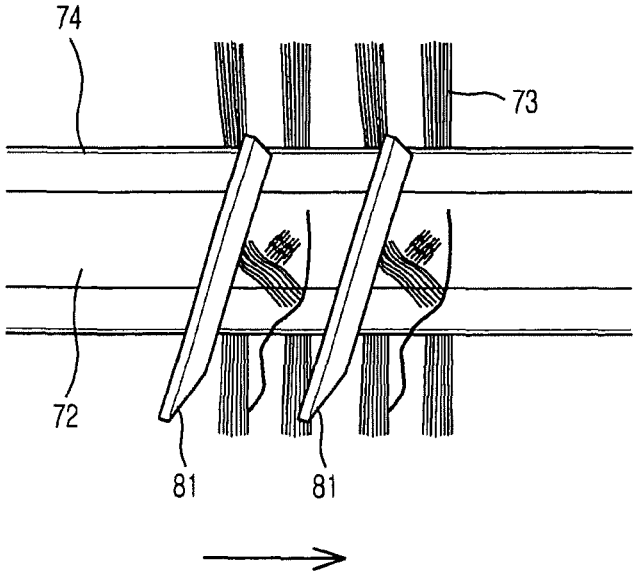
Figure 7:
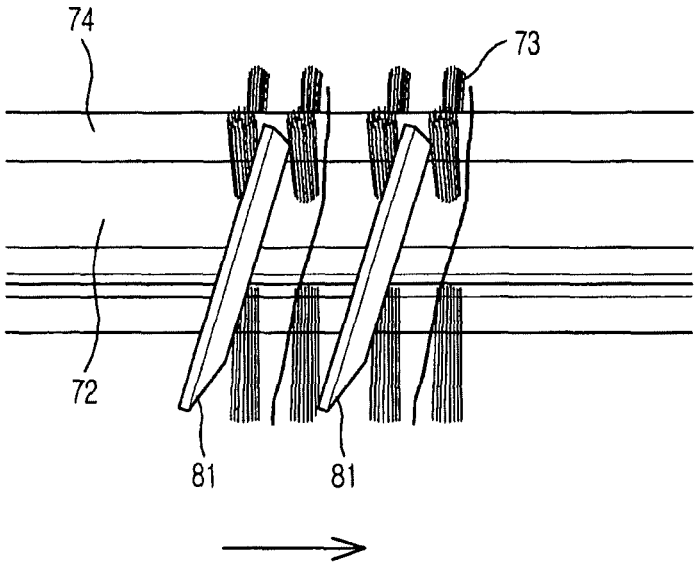

FIGS. 5 to 7 are views illustrating operation of the first brush cleaning members in accordance with the embodiment.

With reference to FIGS. 1 to 7, the first brush cleaning members 81 are protruded and extended from the main body 10 so as to contact the brushes 73. The first brush cleaning members 81 are arranged in the lengthwise direction of the brush unit 70, and move foreign substances wound on the brush unit 70 to the central portion of the brush unit 70. That is, the first brush cleaning members 81 are installed such that the first brush cleaning members 81 at one side and the first brush cleaning members 81 at the other side are symmetrical with respect to the center of the brush unit 70.

More specifically, the first brush cleaning members 81 installed at the left side are inclined to the right based on the rotating direction of the brushes 73, and the first brush cleaning members 81 installed at the right side are inclined to the left based on the rotating direction of the brushes 73. The first brush cleaning members 81 installed at the left side move foreign substances to the right, and the first brush cleaning members 81 installed at the right side move foreign substances to the left. The first brush cleaning members 81 installed at the left side apply pressure to the brushes 73 to elastically deform the brushes 73 to the right and thus sequentially move foreign substances to the right, thereby finally moving the foreign substances to the central portion of the brush unit 70.

Further, although not shown in the drawings, the first brush cleaning members 81 installed at the right side apply pressure to the brushes 73 to elastically deform the brushes 73 to the left and thus to sequentially move foreign substances to the left, thereby finally moving the foreign substances to the central portion of the brush unit 70. Therefore, from the standpoint of a rotary axis of the roller 72, the first brush cleaning members 81 prevent the foreign substances from being released to the outside of the roller 72 in the direction of the rotary axis of the roller 72. Accordingly, the first brush cleaning members 81 prevent the foreign substances from being wound on the motor 71 provided at the outside of the roller 72, thereby preventing the motor 72 from stopping.

Figure 8:
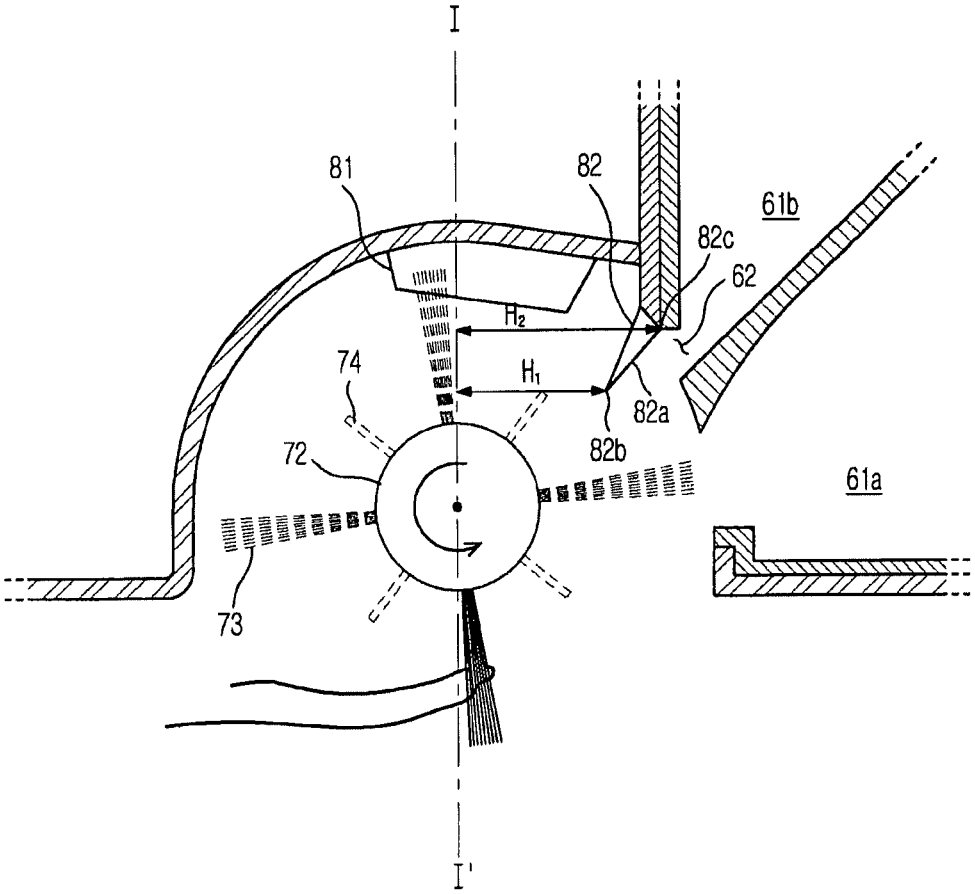
FIGS. 8 to 10 are longitudinal-sectional views illustrating operation of second brush cleaning members in accordance with the embodiment.
Figure 9:
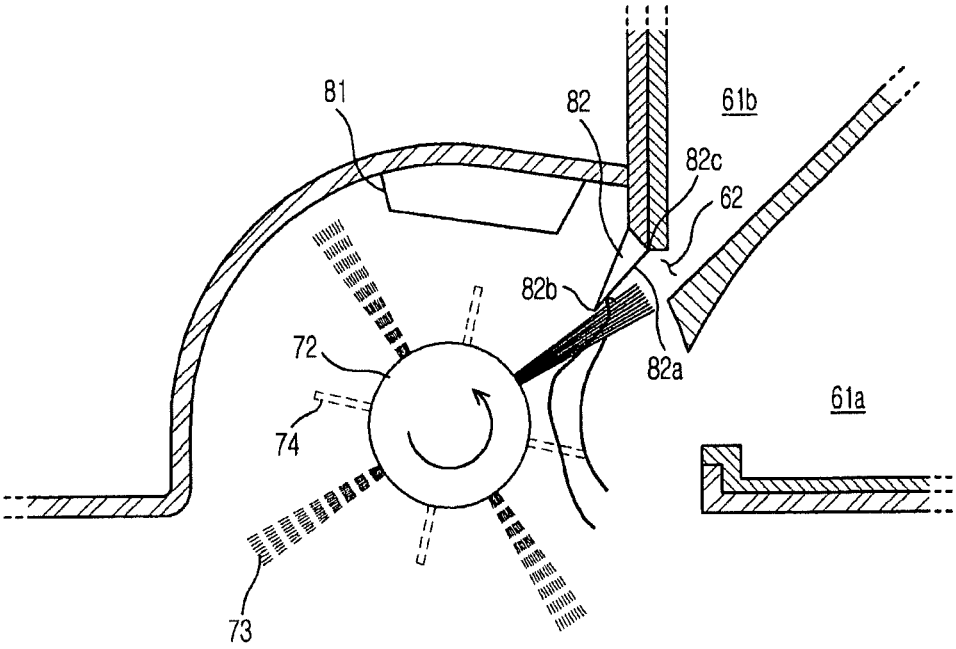
Figure 10:
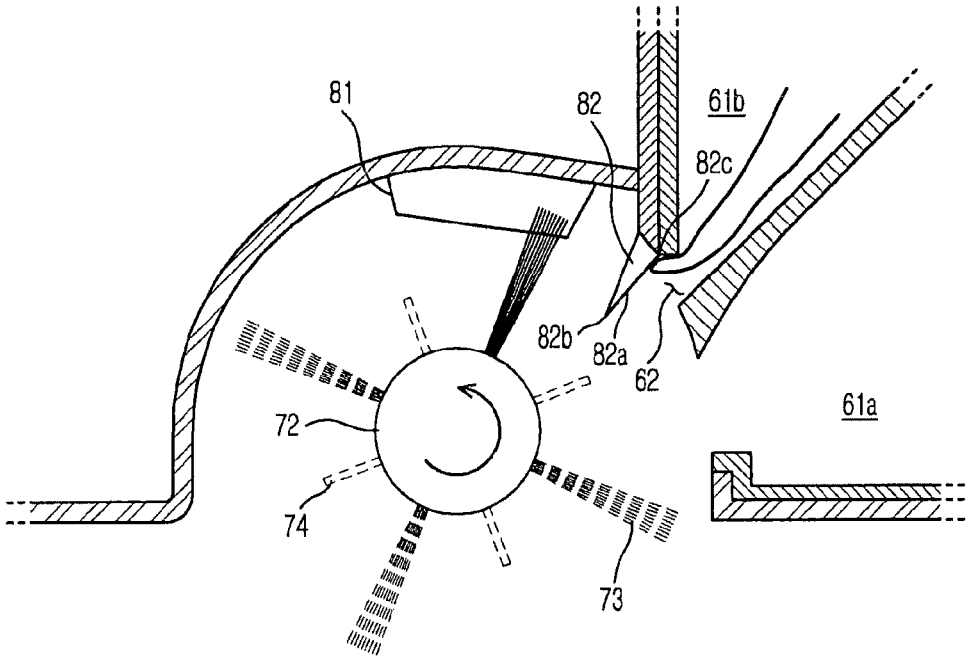

FIGS. 8 to 10 are longitudinal-sectional views illustrating operation of the second brush cleaning members in accordance with the embodiment.

With reference to FIGS. 1 to 10, the second brush cleaning members 82 are protruded and extended from the main body 10 so as to contact the brushes 73. The second brush cleaning members 82 are arranged in the lengthwise direction of the brush unit 70, and separate foreign substances wound on the brush unit 70 to the outside of the brush unit 70. Each of the second brush cleaning members 82 includes a pick-up and guide part 82*a* having a sharpened tip to pick up foreign substances, such as hairs, and then to guide the picked-up foreign substances to the outside of the brush unit 70 along a rotating radius of the brush unit 70. The pick-up and guide parts 82*a* of the second brush cleaning members 82 are formed in the vertical direction, and are approximately parallel to a virtual line I-I' vertically passing through the center or rotation of the brush unit 70.

That is, if a horizontal distance from a lower end 82*b* of the pick-up and guide part 82*a* to the virtual line I-I' is referred to as a first horizontal distance H1 and a horizontal distance from an upper end 82*c* of the pick-up and guide part 82*a* to the virtual line I-I' is referred to as a second horizontal distance H2, the first horizontal distance H1 and the second horizontal distance H2 may be the same or different from each other.

Further, the pick-up and guide parts 82*a* are located at a height lower than a top dead center of a rotating path of the brushes 73 such that the foreign substances are easily separated from the brushes 73. When the brush 73 contacts the pick-up and guide parts 82*a*, the pick-up and guide parts 82*a* pick up foreign substances from the brush 73, and then when the brush 73 moves toward the top dead center of the rotating path, the foreign substances move from the lower ends 82*b* to the upper ends 82*c* of the pick-up and guide parts 92*a*. Thereby, the foreign substances are removed from the brush 73.

The second brush cleaning members 82 are arranged adjacent to the dust collection assembly 60, and thus the foreign substances removed from the brushes 73 may easily move to the dust collection assembly 60 by means of vacuum suction force.

The dust collection assembly 60 includes the dust container 61, a suction channel 62, and a suction fan 63. The dust container 61 is divided into two storage spaces. A first storage space 61*a* of the dust container 61 stores the dust or residue swept by the brush unit 70, and a second storage space 61*b* of the dust container 61 stores the dust or residue scattered by the brush unit 70. The second storage space 61*b* is communicated with the suction channel 62, Vacuum suction force by the suction fan 63 is applied to the suction channel 62, and the second storage space 61*b* stores fine dust particles using the vacuum suction force. Further, foreign substances, such as hairs, removed from the brush unit 70 by the brush cleaning unit 80 are stored in the dust container 61.

Figure 11:
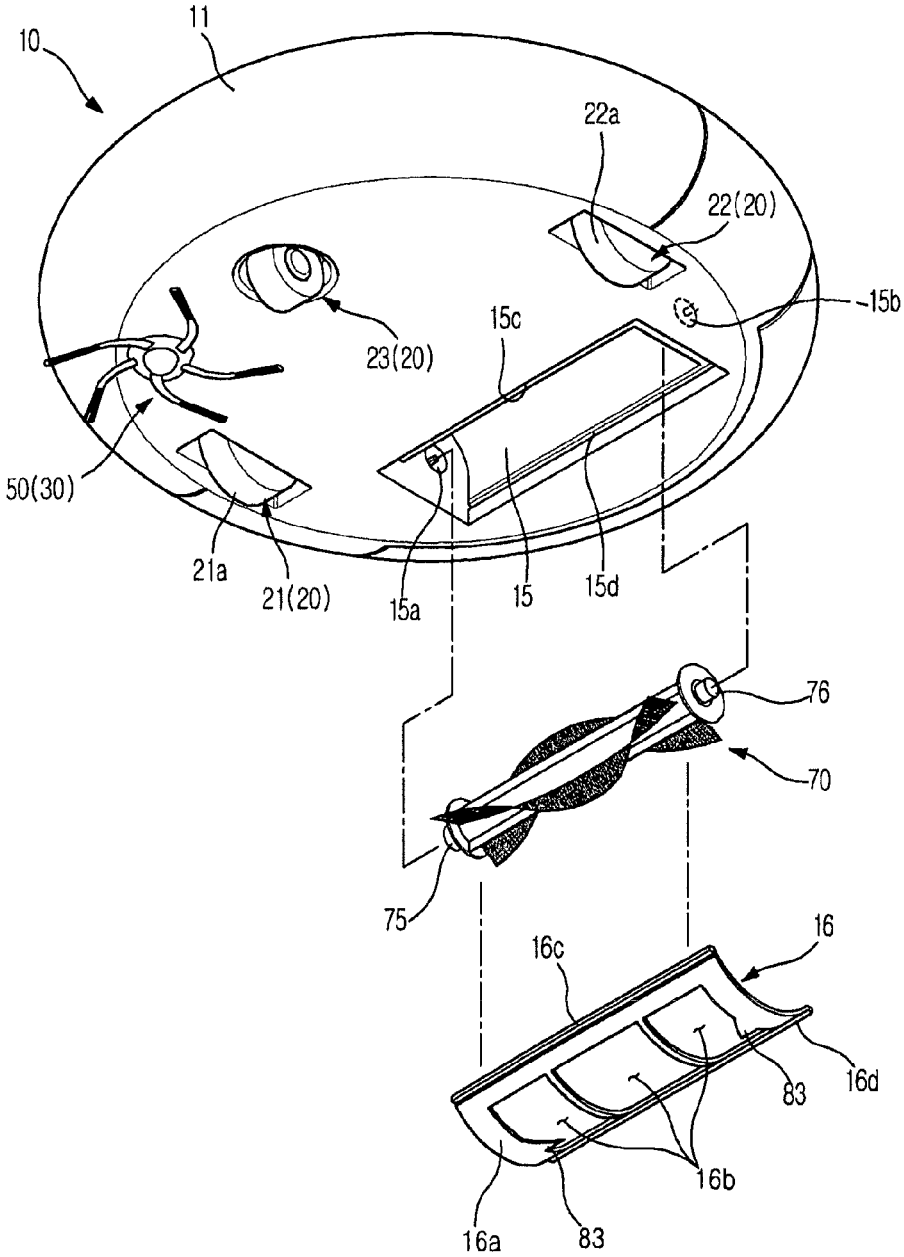
FIG. 11 is a bottom perspective view of an autonomous cleaning machine in accordance with another embodiment.
Figure 12:
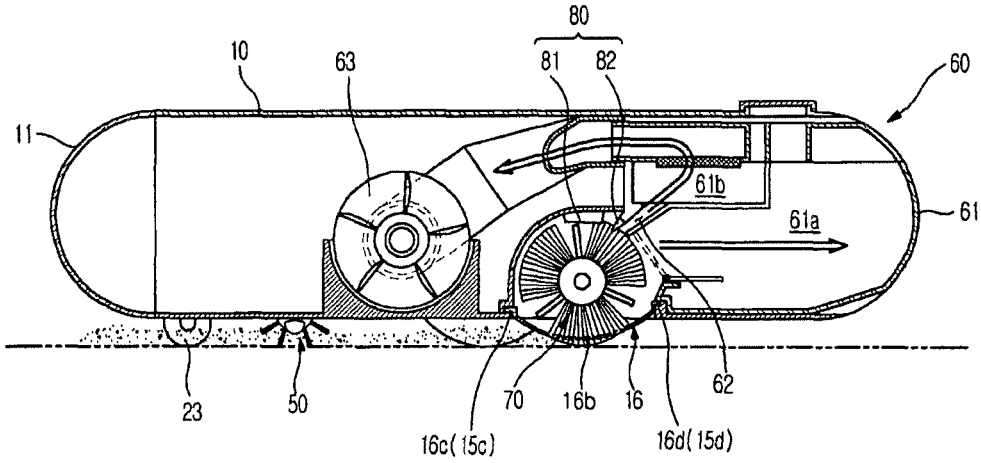
FIG. 12 is a longitudinal-sectional view of the autonomous cleaning machine in accordance with the embodiment.
Figure 13:
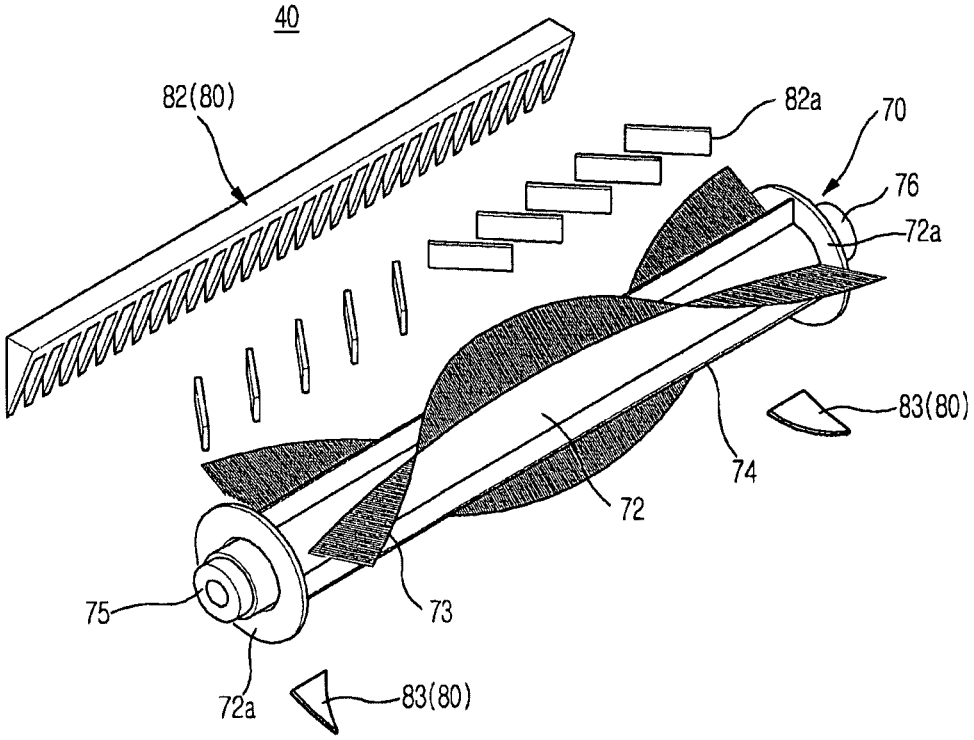
FIG. 13 is a perspective view illustrating a brush unit and a brush cleaning unit in accordance with the embodiment.
Figure 14:
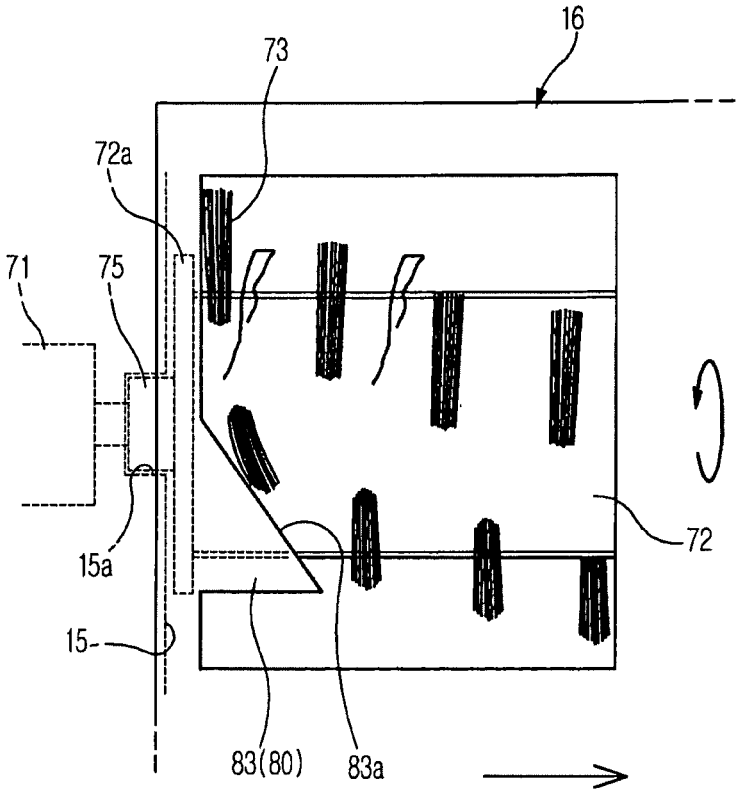
FIGS. 14 and 15 are views illustrating operation of third brush cleaning members in accordance with the embodiment.
Figure 15:
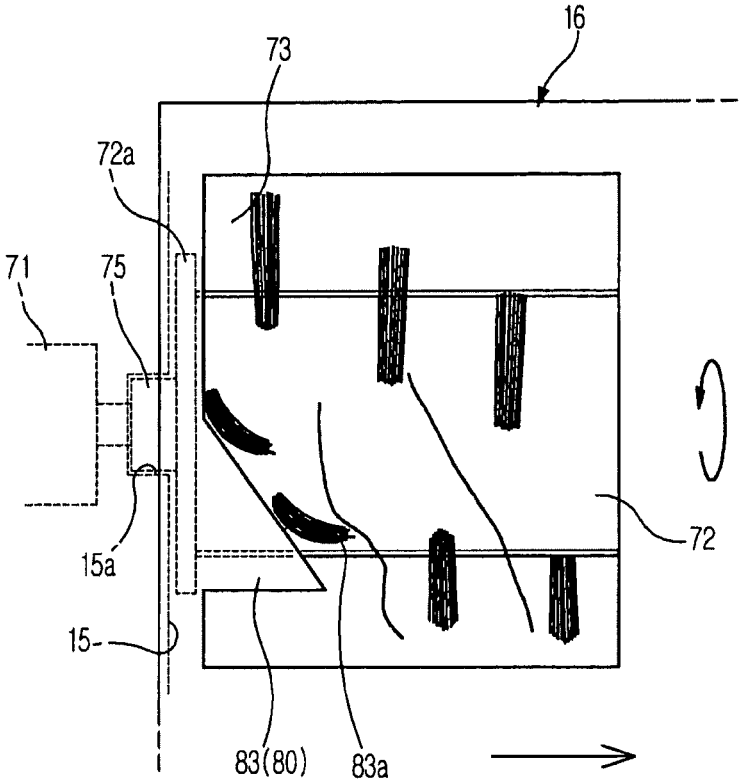

FIG. 11 is a bottom perspective view of an autonomous cleaning machine in accordance with another embodiment, FIG. 12 is a longitudinal-sectional view of the autonomous cleaning machine in accordance with the embodiment, FIG. 13 is a perspective view illustrating a brush unit and a brush cleaning unit in accordance with the embodiment, and FIGS. 14 and 15 are views illustrating operation of third brush cleaning members in accordance with the embodiment. Some parts of the autonomous cleaning machine of FIGS. 11 to 15, which are substantially the same as those of the autonomous cleaning machine 1 of FIGS. 1 to 10, will be denoted by the same reference numerals even though they are depicted in different drawings, and a detailed description thereof will be thus omitted because it is considered to be unnecessary.

As shown in FIGS. 11 to 15, a brush unit 70 is detachably provided on a main body 10. More specifically, the brush unit 70 is detachably provided in a drum case 15 of the main body 10. Here, the brush unit 70 in accordance with this embodiment includes all components of the brush unit 70 in accordance with the earlier embodiment, except for the motor 71. In this embodiment, a motor 71 of the brush unit 70 may be installed within the main body 10.

The brush unit 70 includes a first connection protrusion 75 and a second connection protrusion 76 formed at both ends of a roller 72. The first connection protrusion 75 and the second connection protrusion 76 are protruded from the outer surfaces of end caps 72*a*.

The drum case 15 of the main body 10 includes a first connection recess 15*a* and a second connection recess 15*b*. The first connection protrusion 75 of the brush unit 70 is connected with the first connection recess 15*a* of the drum case 15, and the second connection protrusion 76 of the brush unit 70 is connected with the second connection recess 15*b* of the drum case 15. Here, the motor 71 of the brush unit 70 is connected to the first connection protrusion 75 of the brush unit 70 through the first connection recess 15*a* of the drum case 15.

The main body 10 further includes a brush cover 16 detachably provided on the drum case 15. The drum case 15 of the main body 10 and the brush cover 16 of the main body 10 are configured in a structure to surround the brush unit 70.

The brush cover 16 includes a cover body 16*a*, a first hook part 16*c*, and a second hook part 16*d*.

The cover body 16*a* of the brush cover 16 includes space parts 16*b*, through which the brushes 73 of the brush unit 70 pass, such that the brushes 73 of the brush unit 70 contact the floor. The brushes 73 of the brush unit 70 contact the floor through the space parts 16*b* of the cover body 16*a*, and thus sweep foreign substances on the floor.

The first hook part 16*c* of the brush cover 16 is connected to a first hook groove 15*c* of the drum case 15, and the second hook part 16*d* of the brush cover 16 is connected to a second hook groove 15*d* of the drum case 15. Therefore, the brush cover 16 is easily attached to and detached from the drum case 15 through the above hook connection structure.

Further, a brush cleaning unit 80 further includes at least one third brush cleaning member 83.

The at least one third brush cleaning member 83 is arranged adjacent to connection portions between the brush unit 70 and the drum case 15 of the main body 10, That is the at least one third brush cleaning member 83 is formed on the brush cover 16 of the main body 10 at a position adjacent to the first connection protrusion 75 of the brush unit 70 and the first connection groove 15*a* of the drum case 15 of the main body 10 and at a position adjacent to the second connection protrusion 76 of the brush unit 70 and the second connection groove 15*b* of the drum case 15 of the main body 10.

The at least one third brush cleaning member 83 is protruded and extended from the brush cover 16 so as to contact the brushes 73. That is, the at least one third brush cleaning member 83 is protruded and extended from the outside to the inside of the brush unit 70 in the lengthwise direction of the brush unit 70. Thus, the at least one third brush cleaning member 83 may apply pressure to the brushes 73 provided at the ends of the brush unit 70.

The at least one third brush cleaning member 83 includes an inclined part 83*a* inclined at a designated angle. The brushes 73 provided at the ends of the brush unit 70 may be elastically deformed toward the center of the brush unit 70 by the inclined part 83*a* of the at least one third brush cleaning member 83 as the brush unit 70 is rotated.

Therefore, foreign substances wound on the brushes 73 provided at the ends of the brush unit 70 move to the center of the brush unit 70 by the at least one third brush cleaning member 83. Thereby, the at least one third brush cleaning member 83 is arranged adjacent to connection portions between the brush unit 70 and the drum case 15 of the main body 10, and moves the foreign substances wound on the brush unit 70 to other portions except for the connection portions, i.e., the center of the brush unit 70, thereby preventing the foreign substances from being wound on the connection portions.

Figure 16:
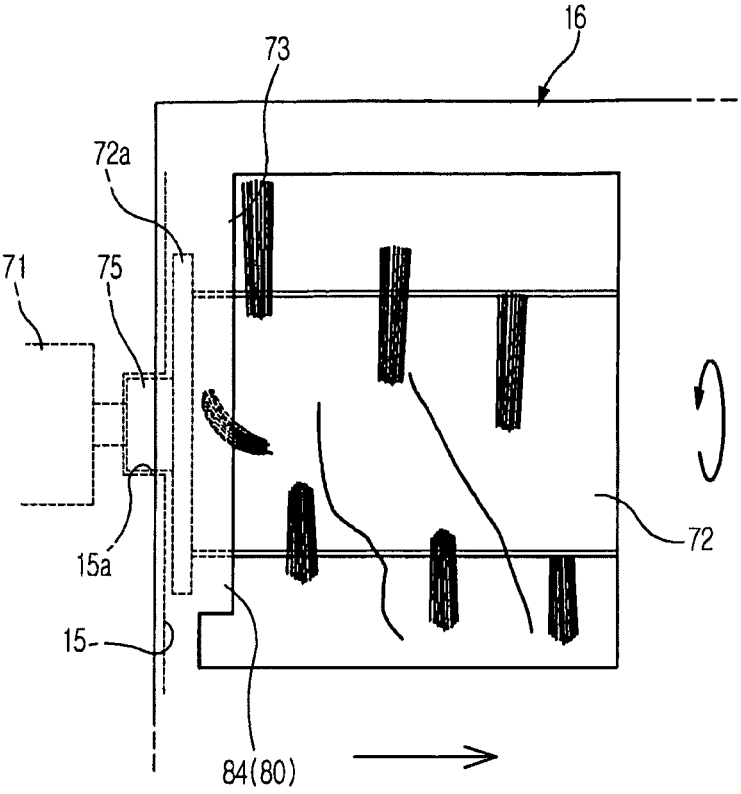
FIG. 16 is a view illustrating another shape of the third brush cleaning member in accordance with the embodiment.

FIG. 16 is a view illustrating another shape of the third brush cleaning member in accordance with an embodiment.

As shown in FIG. 16, at least one third brush cleaning member 84 may be formed in various shapes. That is, the shape of the at least one third brush cleaning member 84 may not be limited as long as the at least one third brush cleaning member 84 has a structure which is arranged adjacent to connection portions between the brush unit 70 and the drum case 15 of the main body 10 and prevents foreign substances wound on the brush unit 70 from moving to the connection portions.

Hereinafter, operation of the autonomous cleaning machine in accordance with embodiments will be described in detail.

With reference to FIGS. 1 to 15, the controller of the autonomous cleaning machine 1 controls the driving wheel assemblies 21 and 22 such that the autonomous cleaning machine 1 travels in a region to be cleaned. There are various traveling methods, such as a zigzag traveling method, an obstacle following-mode traveling method, and an obstacle avoiding-mode traveling method. The controller selects a proper traveling method based on a signal of the sensor, etc.

While the autonomous cleaning machine 1 travels, the edge cleaning assembly 50 sweeps foreign substances in regions around the autonomous cleaning machine 1, and moves the foreign substances to the main cleaning assembly

40. The main cleaning assembly 40 sweeps dust or residue under the autonomous cleaning machine 1. The dust collection assembly 60 contains dust or residue swept by the brush unit 70 or stores dust or residue scattered by the brush unit 70 by suction.

Further, among dust or residue, foreign substances, such as hairs, may be wound on the brushes 73. The foreign substances wound on the brushes 73 are removed by the brush cleaning unit 80. That is, the foreign substances wound on the brushes 73 are moved to the inside of the roller 72, i.e., the center of the roller 72 by the at least one third brush cleaning member 83, the foreign substances moved to the inside of the roller 72 by the at least one third brush cleaning member 83 are collected at the central region of the roller 72 by the first brush cleaning members 81, and the foreign substances collected at the central region of the roller 72 by the first brush cleaning members 81 are removed from the brushes 73 by the second brush cleaning members 82. Particularly, the first brush cleaning members 81 may be used together with the second brush cleaning members 82. If the first brush cleaning members 81 are provided and the second brush cleaning members 82 are not provided, foreign substances wound on the brush unit 70 are collected at the central region of the brush unit 70 and then may become tangled at the central region of the brush unit 70. The foreign substances removed from the brushes 73 are stored in the dust container 61 by vacuum suction force of the dust collection assembly 60.

After cleaning by the autonomous cleaning machine 1 has been completed, the user may separate the dust container 61 from the main body 10 and then remove the stored dust or residue from the dust container 61, or may connect a separate dust suction device to the dust container 61 to remove the stored dust or residue from the dust container 61.

Consequently, since the brush cleaning unit 80 to clean the brush unit 70 is mechanically provided, a fault generation rate of the brush unit 70 may be minimized, and the performance of the brush unit 70 may be uniformly maintained.

As is apparent from the above description, an autonomous cleaning machine in accordance with embodiments allows a cleaning device to maintain performance thereof to be more than a designated level, thereby being capable of maintaining cleaning performance of the cleaning machine to be more than a designated level.

Although a few embodiments have been shown and described, it would be appreciated by those skilled in the art that changes may be made in these embodiments without departing from the principles and spirit thereof, the scope of which is defined in the claims and their equivalents.

What is claimed is:

1. An autonomous cleaning machine to clean a floor comprising:

a main body including a suction unit;

an edge cleaning assembly installed at one side of the main body and moving dust into a traveling path of the autonomous cleaning machine;

a main cleaning assembly rotatably provided on the main body and removing the dust on the traveling path while moving the autonomous cleaning machine along the traveling path;

first brush cleaning unit including a plurality of members and contacting the main cleaning assembly to move foreign substances wound on the main cleaning assembly in a lengthwise direction of the main cleaning assembly;

second brush cleaning unit including second brush cleaning members contacting the main cleaning assembly to pick up the foreign substances wound from the main cleaning assembly; and a dust collection assembly provided in the main body and having a vacuum suction channel along a lengthwise direction of the main cleaning assembly, wherein the plurality of members are installed such that each of the plurality of members is respectively inclined in a designated direction based on a rotating direction of the main cleaning assembly, wherein the second brush cleaning members are positioned adjacent to the vacuum suction channel, so that foreign substances removed from the main cleaning assembly are collected in the dust collection assembly through the vacuum suction channel.

2. The autonomous cleaning machine according to claim 1, wherein the plurality of members are arranged symmetrically to move the foreign substances to a central portion of the main cleaning assembly.

3. The autonomous cleaning machine according to claim 1, wherein the first brush cleaning unit provided at a first side of the cleaning machine are inclined to a second side of the cleaning machine based on a rotating direction of the main cleaning assembly, and the first brush cleaning unit provided at the second side are inclined to the first side based on the rotating direction of the main cleaning assembly.

4. The autonomous cleaning machine according to claim 1, wherein the second brush cleaning members are arranged in a lengthwise direction of the main cleaning assembly.

5. The autonomous cleaning machine according to claim 1, wherein each of the second brush cleaning members includes a pick-up and guide part to pick up the foreign substances wound on the main cleaning assembly and to move the foreign substances to an outside of the main cleaning assembly along a rotating radius of the main cleaning assembly.

6. The autonomous cleaning machine according to claim 5, wherein the pick-up and guide part is arranged in the vertical direction.

7. The autonomous cleaning machine according to claim 5, wherein the pick-up and guide part is located at a height lower than a top dead center of the rotating radius of the main cleaning assembly.

8. The autonomous cleaning machine according to claim 7, wherein the pick-up and guide part guides the foreign substances to the dust collection assembly.

9. The autonomous cleaning machine according to claim 7, wherein the pick-up and guide part includes a sharpened part which is interfered with by the main cleaning assembly.

* * * * *